US005884377A

United States Patent [19]

Rutz et al.

[11] Patent Number: 5,884,377

[45] Date of Patent: Mar. 23, 1999

[54] APPARATUS FOR SPREADING AND MANGLING TUBULAR KNITTED FABRICS

[75] Inventors: Andreas Rutz, Lindau; Werner Strudel, Friedrichshafen, both of Germany

[73] Assignee: Lindauer Dornier Gesellschaft mbH, Lindau, Germany

[21] Appl. No.: 9,711

[22] Filed: Jan. 20, 1998

[30] Foreign Application Priority Data

Jan. 17, 1997 [DE] Germany ..... 197 01 415.1

[51] Int. Cl.[6] ..... D06C 5/00

[52] U.S. Cl. ..... 26/85; 26/84; 26/80

[58] Field of Search ..... 26/80, 83, 84, 26/85, 51; 68/22 R

[56] References Cited

U.S. PATENT DOCUMENTS

| | | | |
|---|---|---|---|
| 2,045,755 | 6/1936 | Cohn | 26/85 |
| 2,294,642 | 9/1942 | Wedler | 26/85 |
| 3,501,818 | 3/1970 | Heitkamp | 26/85 |
| 3,616,502 | 11/1971 | Aronoff | 26/85 |
| 4,885,826 | 12/1989 | Strudel . | |
| 5,233,734 | 8/1993 | Strudel et al. | 26/85 |
| 5,279,023 | 1/1994 | Strudel et al. . | |
| 5,519,922 | 5/1996 | Strudel . | |
| 5,594,978 | 1/1997 | Ferraro | 26/84 |

FOREIGN PATENT DOCUMENTS

| | | | |
|---|---|---|---|
| 460687 | 10/1968 | Switzerland | 26/85 |
| 940339 | 10/1963 | United Kingdom | 26/85 |

*Primary Examiner*—Amy B. Vanatta
*Attorney, Agent, or Firm*—W. F. Fasse; W. G. Fasse

[57] ABSTRACT

A mangle for circular knitted fabric has a circular spreader is combined with several mangling stations circularly arranged around the spreader for the removal of treatment liquor from tubular fabrics. In order to protect the fabric against excessive squeezing, an upper roller head is entirely avoided by confining the circular spreader in the horizontal direction exclusively by the mangling stations. The vertical support of the spreader is provided fully by the mangling stations if the mangling rollers are mounted in positions slanting to the vertical. If the mangling rollers are not mounted in slanted positions it is preferred that a lower roller head operated by a lifting mechanism assists the mangling rollers in supporting the spreader (8) vertically. In both instances an upper roller head becomes unnecessary.

11 Claims, 7 Drawing Sheets

SM
LOWER
POSITION OF HEAD 11

34
1
2
3
20A
A
24
30
30
12
α
23A
21
13
β
26B
23A
26B
30
30
25
19B
8
20B
20B
5
T
M
22
9
11
T
LIFTING
RANGE
10
36
22
18
17A
11
ROLLER
HEAD 11 IN
LOWER POSITION 34
18'
1
20A
33
5
SM
24
PCD
12
α
13
19A
β
13
23A
19C
26A
21
25
27
8
19B
5
20B
A
IR

APPARATUS FOR SPREADING AND MANGLING TUBULAR KNITTED FABRICS

FIELD OF THE INVENTION

The invention relates to an apparatus with squeezing rollers for removing treatment liquor from tubular knitted fabrics by a mangling operation.

BACKGROUND INFORMATION

U.S. Pat. No. 4,885,826 (Strudel), issued on Dec. 12, 1989, describes a tubular fabric expander or spreader which is held externally by upper and lower spreader heads (10, 10') each including a plurality of rollers (11, 12; 11', 12'). A float body (9) is inserted between the spreader and the lower support rollers (11', 12'). Lateral mangling stations are not disclosed in U.S. Pat. No. 4,885,826.

U.S. Pat. No. 5,279,023 (Strudel et al.), issued on Jan. 18, 1994 describes a method for avoiding edge markings in tubular knitted fabrics and an apparatus for carrying out such a method. The apparatus has rotatable inner and outer squeezing or mangling roller stations which are adjustable in their diameter. The tubular knitted fabric passes through between the inner and outer mangling roller stations. The inner mangling roller station corresponds substantially to an expander for tubular textile fabric. However, each of the longitudinal guide rollers of the earlier Strudel apparatus has been replaced by a pair of inner squeezing rollers. In the Strudel et al. apparatus upper and lower spreader heads (11, 11') with respective sets of rollers (9', 12'; 9, 12) are used to axially and laterally hold the inner mangling rollers.

U.S. Pat. No. 5,519,922 (Strudel), issued on May 28, 1996 describes a spreader and mangle for tubular fabric with upper and lower roller heads which leave room for improvement regarding these roller heads.

Each pair of squeezing rollers of the inner mangling roller station forms, together with one squeezing roller of the outer roller station, a so-called partial squeezer. The arrangement is such that in a squeezing operation of tubular fabric a power driven squeezing roller of the outer station reaches between the two squeezing rollers of each squeezing roller pair of the inner station, whereby a respective reach is controlled. The treatment liquor is thus substantially squeezed out of the tubular fabric.

The fabric is kept in a spread state by a spreader device provided with roller heads at the upper and lower ends of the apparatus. The roller heads in turn are supported by respective fixing or positioning rollers. The roller heads with their positioning rollers fix the position of the spreader mechanism and simultaneously permit the motor driven width adjustment of the spreader mechanism by a lifting device such as a piston cylinder which is connected to the mounting of the lower roller head.

The just described conventional spreader station works well for its intended spreading purpose, but leaves room for improvement with regard to the guiding of the fabric after the treatment liquor has been squeezed out of the tubular fabric.

OBJECTS OF THE INVENTION

In view of the foregoing it is the aim of the invention to achieve the following objects singly or in combination:

- to construct an apparatus for spreading and mangling tubular fabrics which avoids an irregular application of pressure to the fabric after the treatment liquor has been squeezed out of the fabric to thereby assure a uniform fabric quality;

- to avoid or at least substantially reduce any application of squeezing pressure to the fabric once the fabric has passed the mangling or squeezing out rollers;
- to make sure that the fabric after mangling can be pulled off or out of the apparatus without any hindrances and without the need for guiding the fabric over an upper roller head so that a uniform fabric quality is assured; and
- to support the spreader laterally or horizontally exclusively by mangling rollers and vertically also by these mangling rollers or by a lower roller head and by the mangling rollers.

SUMMARY OF THE INVENTION

The above objects have been achieved in a mangle according to the invention by restraining and/or holding the fabric spreader (8) in its horizontal position solely by mangling stations (13) and by providing an adjustment mechanism for the control of the diameter of the spreader (8) in the horizontal direction to make its diameter larger or smaller. A lifting mechanism (17) is positioned below the spreader. The holding of the spreader (8) in the horizontal direction exclusively by the mangling stations (13) without an upper roller head is combined according to the invention with a mechanism for adjusting the spreader diameter by tilting spreader mounting struts away from a central spreader support post (19) to increase the diameter or toward the post (19) for decreasing the spreader diameter.

According to a first embodiment the spreader diameter adjustment mechanism is characterized by a first lower roller head (11), an axial bearing (22) supported by said first lower roller head (11), said outer tubular member (19A) having a lower end resting on said axial bearing (22), a lifting and lowering mechanism (17) positioned below said first roller head (11), a second roller head (31) supported by said lifting and lowering mechanism (17), a rod (36) passing through said first roller head (11) and through said axial bearing (22) into said outer tubular member (19A) of said central carrier post (19), said rod (36) having a lower end connected to said second roller head (31) and an upper end connected to said inner member (19B) of said central carrier post (19), so that lowering said rod (36) with said mechanism (17) tilts said struts outwardly for increasing said spreader diameter and raising said rod (36) with said mechanism (17) tilts said struts inwardly for decreasing said spreader diameter.

A second embodiment of the present spreader diameter adjustment mechanism is characterized by a single lower roller head (11), an axial bearing (22) supported by said single lower roller head, said telescoping inner member (19B) of said central carrier post (19) having a lower end extending out of said outer tubular member (19A) and resting on said axial bearing (22), a lifting and lowering mechanism (17) supporting said single lower roller head (11) so that lifting said lower roller head (11) moves said inner telescoping member (19B) upwardly into said outer tubular member (19A) thereby increasing said spreader diameter and lowering said lower roller head moves said inner telescoping member downwardly out of said outer tubular member (19A) thereby decreasing said spreader diameter.

A third embodiment of the present spreader diameter adjustment mechanism is characterized by a piston cylinder device in said outer tubular member (19A) of said central carrier post (19), said piston cylinder device comprising a piston rod (33) extending upwardly out of said outer tubular member (19A) for an axial up-and-down movement (18), said struts comprising upper struts (20A) pivoted to an upper end of said piston rod (23), so that said spreader diameter is reduced in response to said piston rod (33) moving upwardly and so that said spreader diameter is increased in response to said piston rod (33) moving downwardly.

In all three embodiments of the invention it is assured that the tubular fabric can be pulled off the spreader mechanism without hindrance by any upper roller head after the squeezing or mangling is completed. More specifically, it is no longer necessary to guide the squeezed out fabric over a roller head at the top of the apparatus, whereby a uniform quality of the tubular fabric without squeezing marks is assured.

BRIEF DESCRIPTION OF THE DRAWINGS

In order that the invention may be clearly understood, it will now be described, in connection with an example embodiment of the invention with reference to the drawings, wherein.

DETAILED DESCRIPTION OF PREFERRED EXAMPLE EMBODIMENTS AND OF THE BEST MODE OF THE INVENTION

Figure 1:
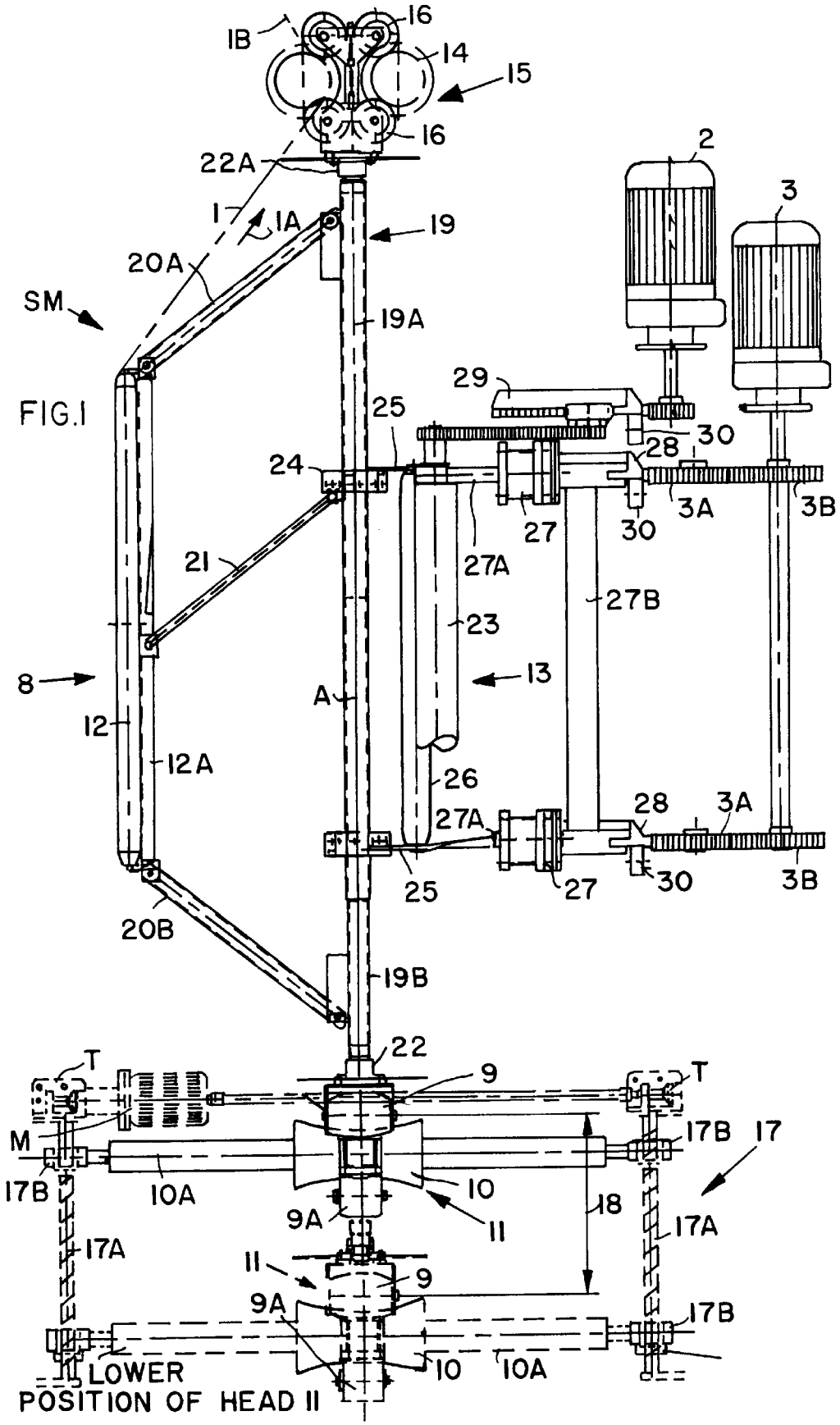
FIG. 1 is an elevational side view partly broken away of a spreader for tubular fabric according to the prior art showing an upper fixed roller head and a lower movable roller head.

FIG. 1 shows a conventional spreader and mangle combination SM as disclosed in U.S. Pat. No. 5,519,922 (Strudel) and modified by a lifter as disclosed in U.S. Pat. No. 4,885,826 (Strudel) mentioned above. Tubular fabric 1 passes through a treatment liquor not shown in the direction of the arrow 1A from the bottom upwardly around the spreader S. The spreader S is supported on a lower roller head 11 which comprises two pairs of fabric guide rollers 9 and 9A and a pair of position fixing rollers 10. The position fixing rollers 10 are rotatably supported by shafts 10A which at their free ends are supported by a lifting mechanism as 17, e.g. with lifting spindles 17A carrying spindle nuts 17B connected to the shafts 10B. The spindles 17A are driven by a motor M through transmissions T. The disclosures of U.S. Pat. Nos. 5,519,922 and 4,885,826 are incorporated herein by reference.

Referring further to FIG. 1, the fabric 1 travels between the support rollers or guides 9 and the position fixing rollers 10 onto the spreader 8. Spreader rollers 12 spread the fabric 1 apart so that it may move through individual mangling stations 13 in such a way that the treatment liquor is squeezed out to fall downwardly by gravity into a collecting container not shown in FIG. 1.

Following the mangling operation, the fabric 1 travels into an upper spreader head 15 comprising two pairs of support or guide rollers 16 and a pair of position fixing rollers 14. The fabric 1B passing out of the upper spreader or roller head 15 is flat again. A power driven roller pair not shown pulls the fabric 1B in its flat form out of the upper spreader head 15. The pulling roller pair is mounted in the spreader frame 5 as is conventional.

The above mentioned lifting mechanism 17 is capable of moving the lower spreader or roller head 11 vertically up and down between an upper position shown in full lines and a lower position shown in dashed lines and as indicated by the double arrow 18.

The spreader 8 has struts 20A, 20B and 21 pivoted at one end to a central carrier post 19, which has an outer tubular member 19A and an inner member 19B that may also be tubular. The other end of the struts 20A, 20B and 21 is pivoted to a bracket 12A carrying a spreader roller 12. The member 19B is mounted with its lower end in an axial bearing 22 that is supported by the lower roller head 11 carried by the lifting mechanism 17, whereby it is possible for the lifting mechanism 17 to move the inner member 19B of the central carrier post 19 in the outer tubular member 19A in a telescoping manner. When the member 19B is moved down, the diameter of the spreader 8 becomes narrower. When the inner member 19B is moved upwardly, the spreader diameter becomes wider.

The upper end of the outer tubular member 19A of the post 19 is conventionally connected to the upper spreader or roller head 15 through a further bearing 22A. Thus, the spreader 8 is held with its carrier post 19 by the bearings 22, 22A between the upper roller head 15 and the lower roller head 11 in a rotatable manner.

Referring further to FIG. 1, radially inner mangling rollers 26 are secured through brackets 24, 25 to the outer tubular member 19A of the central carrier post 19. The rollers 26 are rotatable in the brackets 24, 25 and form part of several squeezing or mangling stations 13 distributing around the spreader 8 as best seen in FIGS. 2A and 3.

In each mangling station two inner mangling rollers 26 cooperate with one outer roller 23 for example. The outer mangling rollers 23 are mounted in the machine frame 5 and are rotated about their own axis by a motor 2 and a gear transmission 29. A motor 3 and further gear transmission rotates the stations 13 around a central spreader axis A. The tubular fabric 1 passing over the spreader guide rollers 12 is mangled when moving through a squeezing gap between the rollers 23 and 26 in each of the mangling stations 13. The squeezing gap and thus the squeezing force F applied to the tubular fabric 1 in the squeezing gap is adjusted by piston cylinder devices 27 carrying the outer squeezing rollers 23.

For this purpose the individual outer mangling rollers 23 are mounted with their free ends to the piston rod 27A of the respective piston cylinder device 27. One such device is provided at each end of the rollers 23. The respective mountings include a bearing to permit the rotation of the rollers 23 with the help of separate roller drives 2. The piston cylinder devices 27 are mounted in the spreader frame 5 and function as supports for the mangling rollers 23 and for producing the squeezing force F. The piston cylinder devices 27 are mounted in a cage 27B which in turn is supported through bearings 28 which in turn are operatively mounted on support rings 30 in the frame 5. The frame 5 comprises vertical posts 5A and cross-beams 5B as best seen in FIGS. 2A and 3A. The cross-beams 5B carry the support rings 30 on which the bearings 28 are rotatably supported for rotation. These bearings have an outer toothed rim that meshes with gear teeth 3A and 3B driven by a motor 3 for rotating the cage 27B and with it the mangling stations 13. Further details of such a drive are described in the above mentioned U.S. Patents, the content of which is incorporated by reference into the present disclosure.

Figure 2:
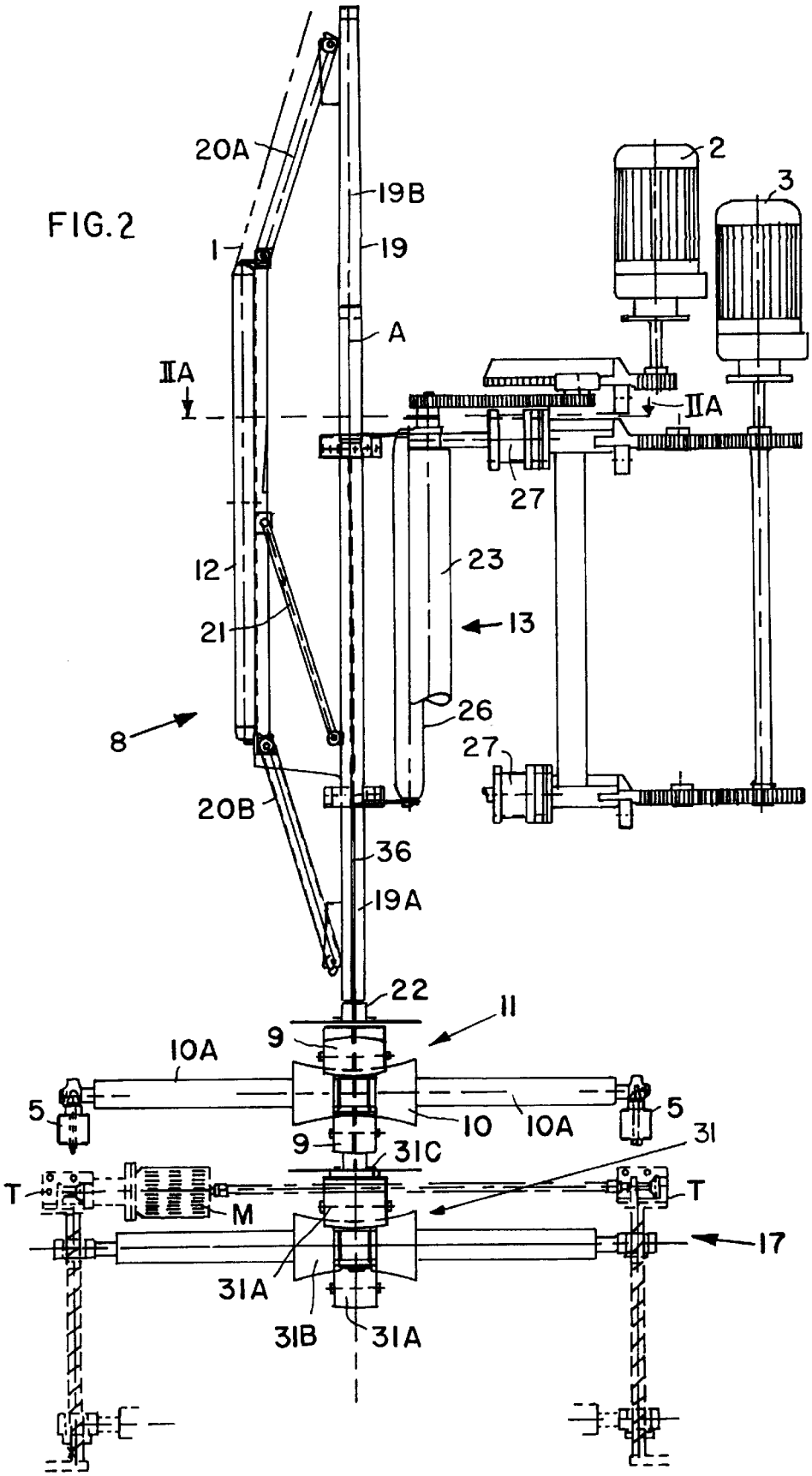
FIG. 2 is a view of a spreader according to the invention without an upper roller head and with the spreader in a small spreader diameter position as controlled by a first embodiment of the present spreader diameter adjustment mechanism with an adjustment rod.
Figure 2A:
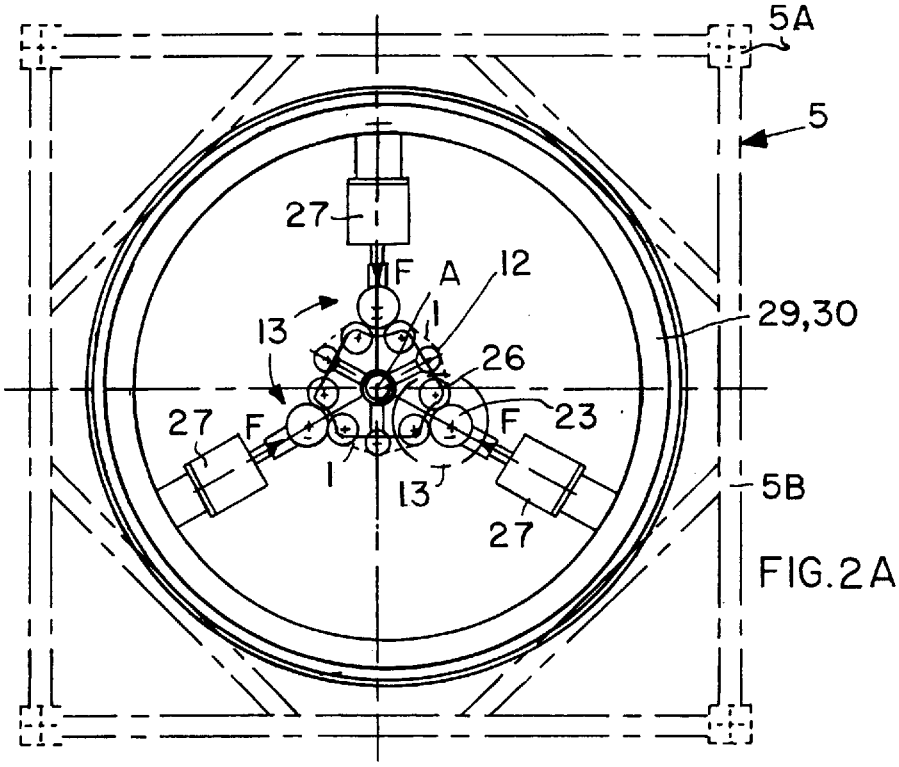
FIG. 2A illustrates a view approximately onto a plane IIA—IIA in FIG. 2 showing three mangling stations circumferentially distributed around the spreader in its small diameter position.
Figure 3A:
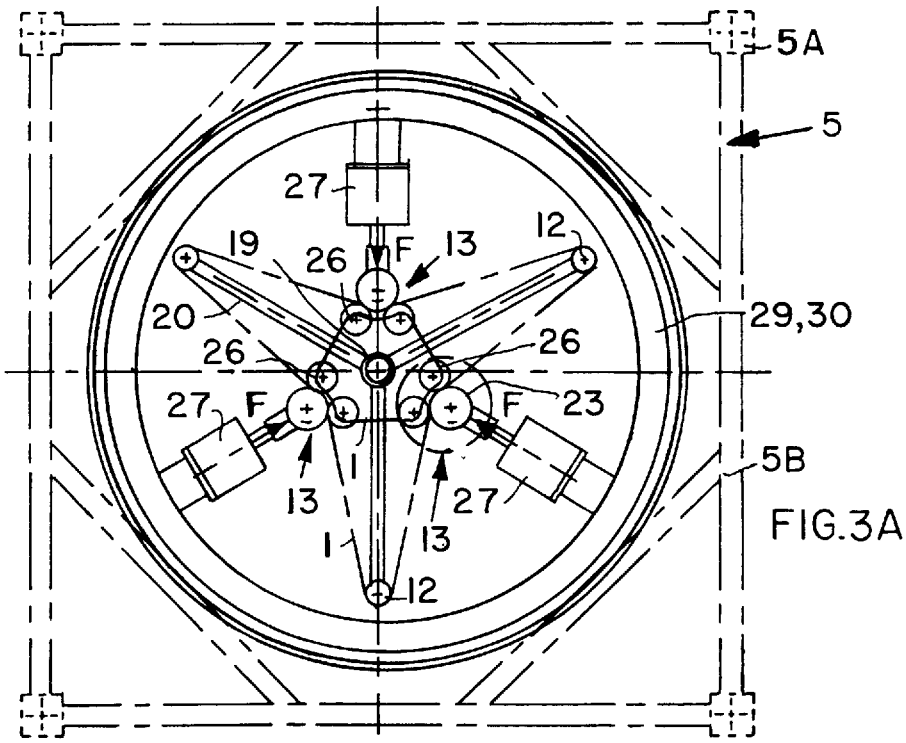
FIG. 3A is a view similar to FIG. 2A onto a plane IIIA—IIIA in FIG. 3 showing the spreader in its large diameter position.
Figure 3:
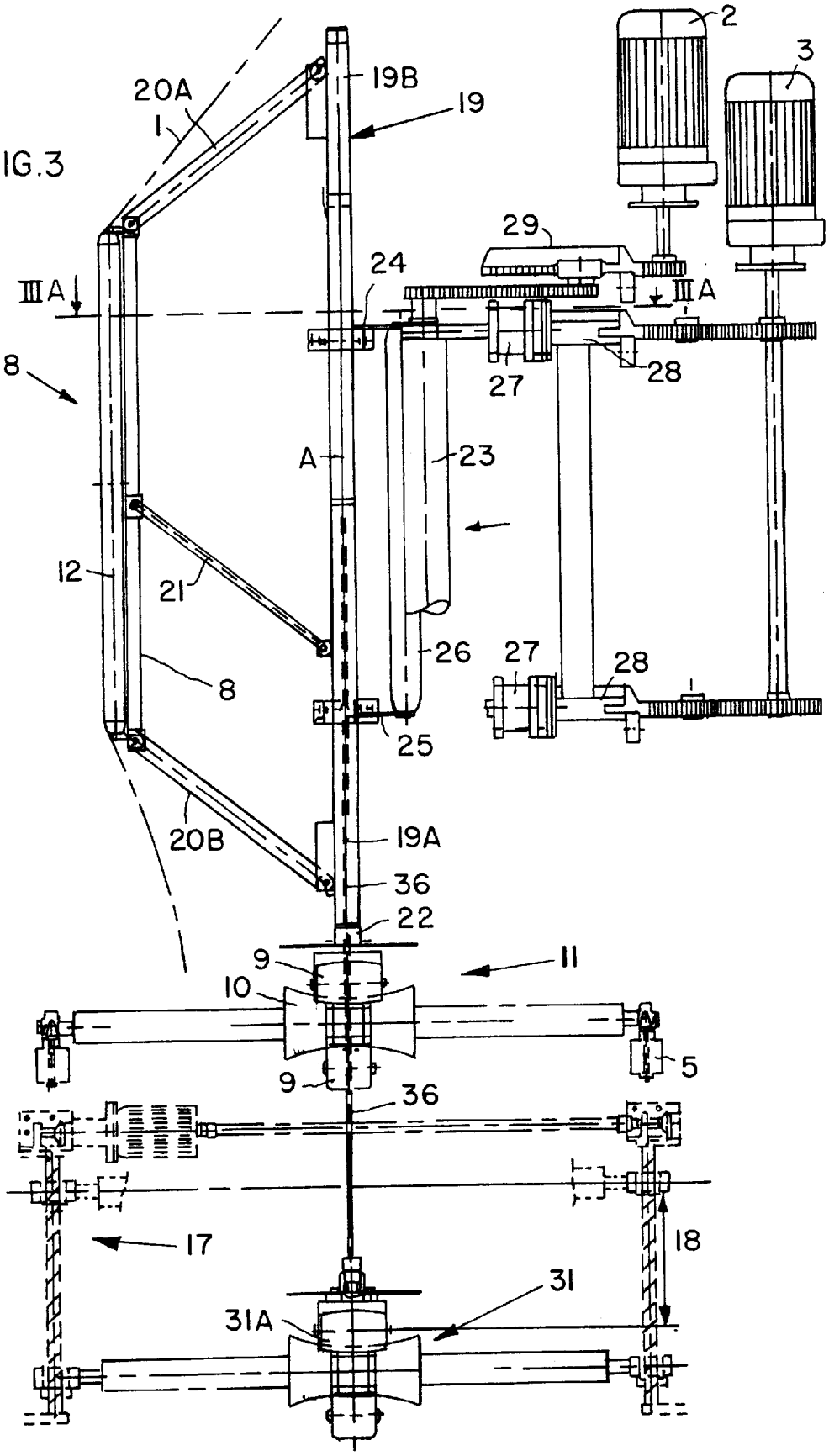
FIG. 3 is a side view similar to that of FIG. 2, but illustrating the spreader in its large diameter position adjusted by the adjustment rod.

FIG. 2 shows a first embodiment of the invention wherein an upper spreader head shown at 15 in FIG. 1 is avoided altogether and additionally the horizontal positioning of the spreader 8 is taken over substantially by the, for example three, mangling stations 13 distributed about the central axis A as seen in FIG. 2A. The weight of the spreader 8 is taken up by a stationary lower roller head 11 positioned below the spreader 8. The roller head 11 is supported by position fixing rollers 10 through shafts 10A, the ends of which are mounted in the machine frame 5. The roller head 11 supports the outer tubular member 19A of the central carrier post 19 by a rotary axial bearing 22. One end of the struts 20B and 21 is pivoted to the outer tubular member 19A while one end of the inner tubular member 19B of the post 19 is pivoted to the struts 20A. The other strut ends are pivoted to the brackets 12A that carry the spreader rollers 12.

According to the invention, the inner tubular member 19B is connected through a rod 36 to a further lower roller head 31 for adjusting the diameter of the spreader 8. FIG. 2 shows a small spreader diameter since the rod 36 has lifted the inner telescoping member 19B in response to operation of the lifting mechanism 17 which lifted the roller head 31. The rod 36 passes axially inside the central post 19 and through between the rollers 9, 10 of roller head 11. The lower end of the rod 36 is mounted in a support 31C carried by the roller head 31 having guide rollers 31A and positioning rollers 31B. In FIG. 2, the lifting mechanism 17 has brought the roller head 31 to its upper position to adjust the radial width of the spreader 8 to its small diameter.

FIG. 3 shows the embodiment of FIG. 2 with the rod 36 moved downwardly, whereby the spreader 8 has been expanded to its large diameter.

FIG. 2A shows the radially inner position of the spreader guide rollers 12 between three circumferentially distributed mangling stations 13 corresponding to FIG. 2. FIG. 3A shows the radially outer position of the spreader guide rollers 12 between the three circumferentially distributed mangling stations 13 corresponding to FIG. 3.

Figure 4:
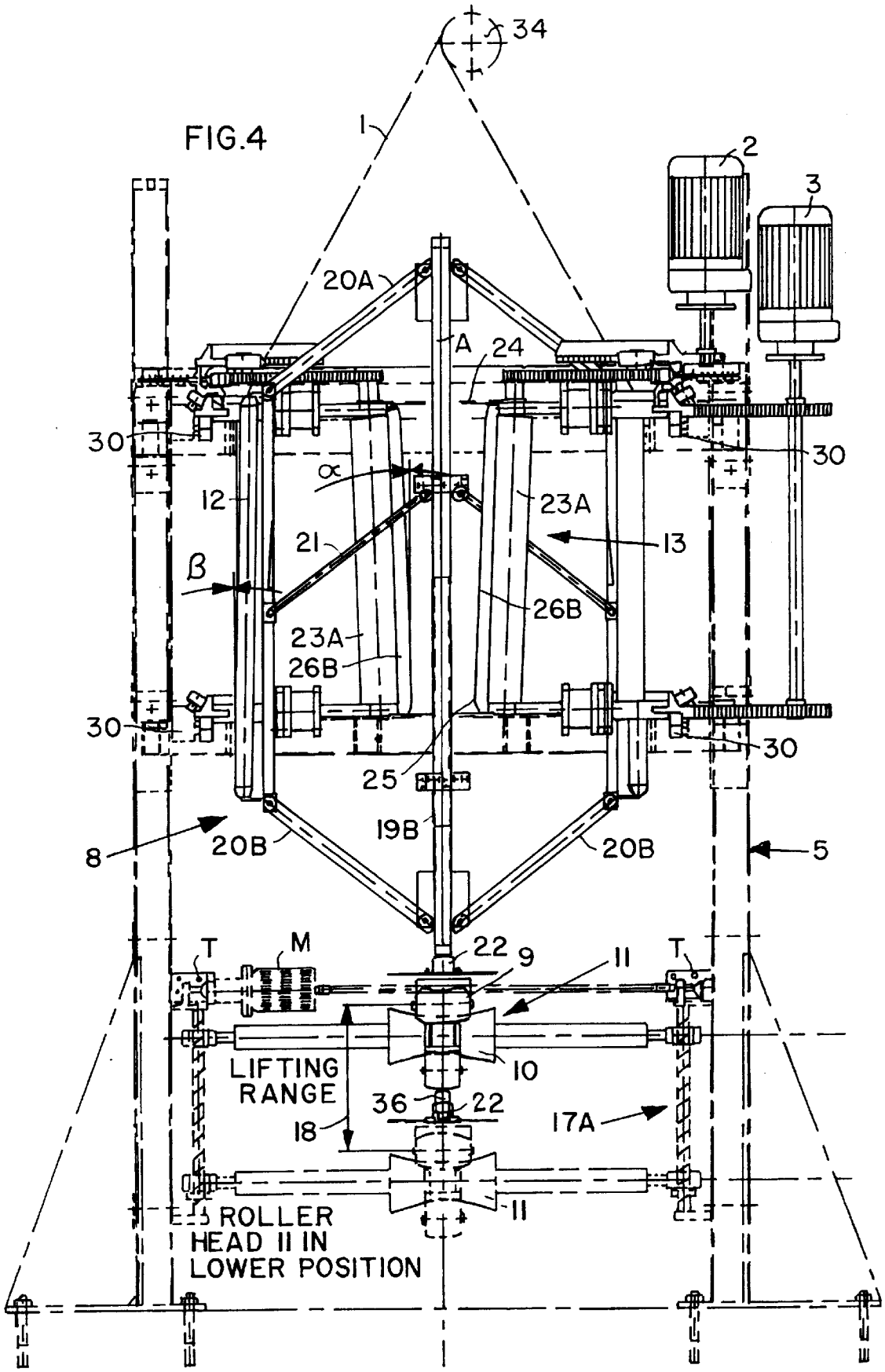
FIG. 4 shows a second embodiment of the spreader diameter adjustment mechanism according to the invention in which the spreader diameter is adjusted by a single lower roller head that is axially movable for adjusting a telescoping position of telescoping members of a central carrier post of the spreader.

In the embodiment of FIG. 4 a further roller head 31 is not used. Rather, the lower roller head 11 is mounted in the lifter 17. The weight of the spreader 8 is taken up entirely by the mangling stations 13 which also fix the spreader 8 in its horizontal position. This support of the spreader 8 is possible because the squeezing rollers 23A and 26A of the mangling stations are arranged at an angle $\alpha$ relative to the vertical whereby a V-shaped socket or basket, so to speak, is formed in which the central spreader 8 is held in position. The "basket" opens upwardly to receive the spreader 8. Thus, the spreader 8 is suspended freely in the outer squeezing rollers 23A and a separate roller head for fixing and retaining the weight of the spreader 8 is not necessary in the embodiment of FIG. 3.

The diameter of the spreader 8 is adjusted in FIG. 4 by the lifting mechanism 17A providing a lift for the fixing rollers 10 on which the roller head 11 with its guide rollers 9 is supported. The roller head 11 supports an axial bearing 22 which in turn has mounted therein the inner member 19B of the central carrier post 19. Thus, lifting and lowering the roller head 11 adjusts the spreader diameter.

Due to the slanted position of the squeezing rollers 23A and 26A at the angle $\alpha$ the circumference of the tubular fabric 1 is somewhat smaller in the lower range of the mangling stations 13 than in the upper range thereof. In order to avoid an impairment of a uniform transport of the tubular fabric a compensation is provided for this angular position $\alpha$ by a corresponding angular position of the spreader rollers 12 at an angle $\beta$ which is also measured relative to the vertical. However, the slant or inclination of the angle $\beta$ is opposite to the slant or inclination of the angle $\alpha$. Once the tubular fabric 1 has passed the squeezing or mangling stations 13 it is taken up by a simple pulling roller 34 that pulls the fabric 1 in an upward direction without the application of undesirable non-uniform pressure areas on the tubular fabric by an upper roller head which is omitted by the invention.

Figure 5:
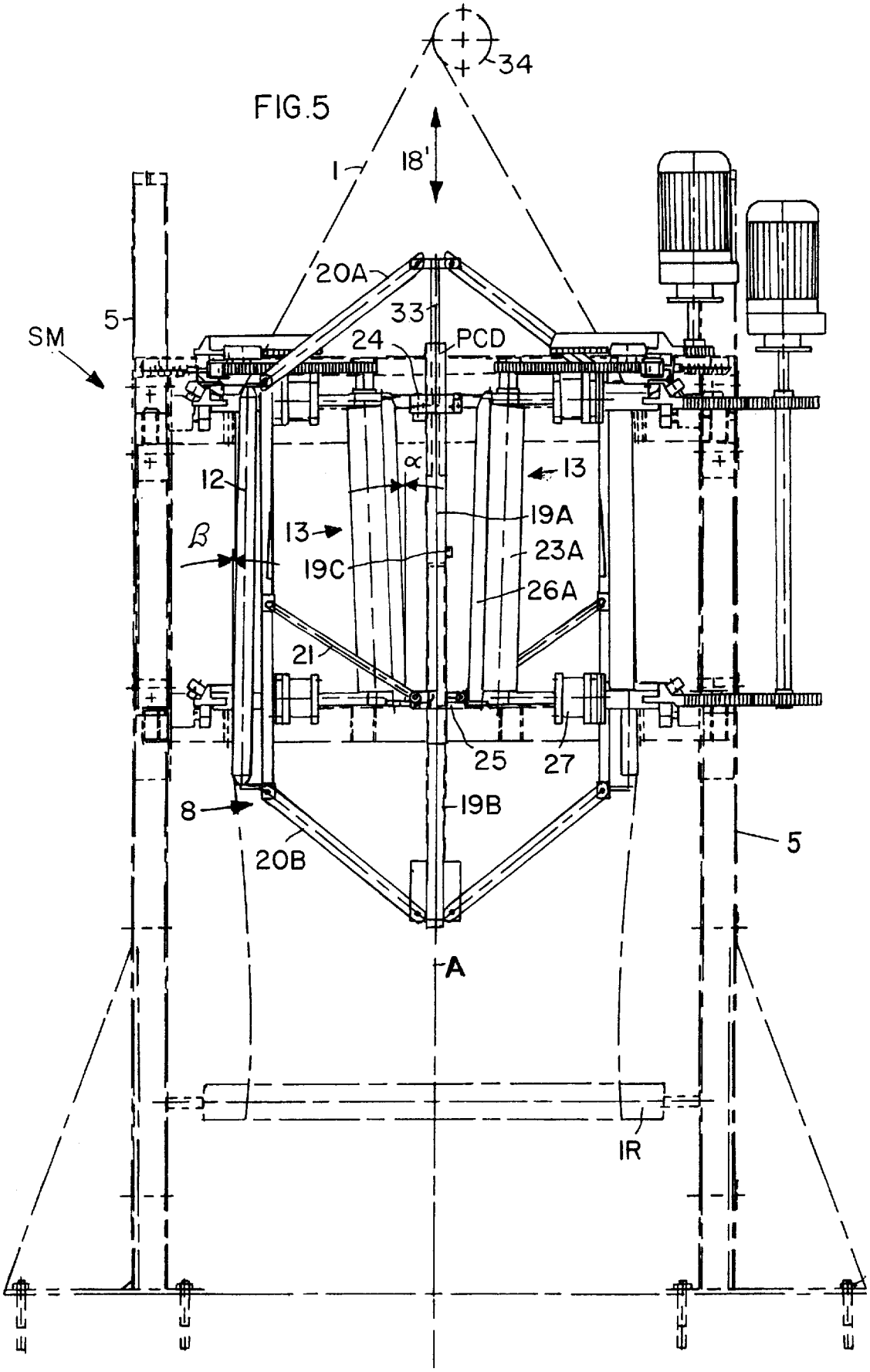
FIG. 5 shows a third embodiment of a spreader diameter adjustment mechanism with piston cylinder device forming part of the central carrier post and wherein the mangling rollers have a slant to fully support the spreader horizontally and vertically.

FIG. 5 shows a further embodiment according to the invention for the adjustment of the spreader diameter and without an upper roller head. The mangling stations 13 and the spreader rollers 12 are projected into the same drawing plane. The arrangement of the spreader 8 and mangling stations 13 in FIG. 5 corresponds substantially to that of FIG. 4, however in FIG. 5 neither a lower roller head 11 nor a lifting mechanism 17A are required. In FIG. 5 the spreader 8 is freely suspended within the basket or cage formed by the outer mangling rollers 23A. A piston cylinder device PCD is arranged inside the central carrier post 19, more specifically inside the outer tubular member 19A. Such an arrangement is similar to a pneumatic spring which is biased to a required spring force by admitting air under pressure through a port 19C to extend a piston rod 33 of the piston cylinder device PCD to the extent required for the diameter expansion of the spreader 8. This expansion is done prior to operation of the spreader mangler SM. As long as a particular tubular fabric 1 runs over the spreader 8 from an inlet roller IR to the pull out roller 34, the spreader diameter remains constant as determined by the biassing pressure in the PCD. Once a run is completed, a different spreader diameter may be adjusted through the port 19C for a different fabric. The piston rod 33 is pivoted to the struts 20A of the spreader 8. By vertically moving the piston rod 33 in the direction 18 up or down it is possible to push the struts 20A more or less upwardly to thereby change or adjust the width of the spreader 8 as described above.

Figure 6:
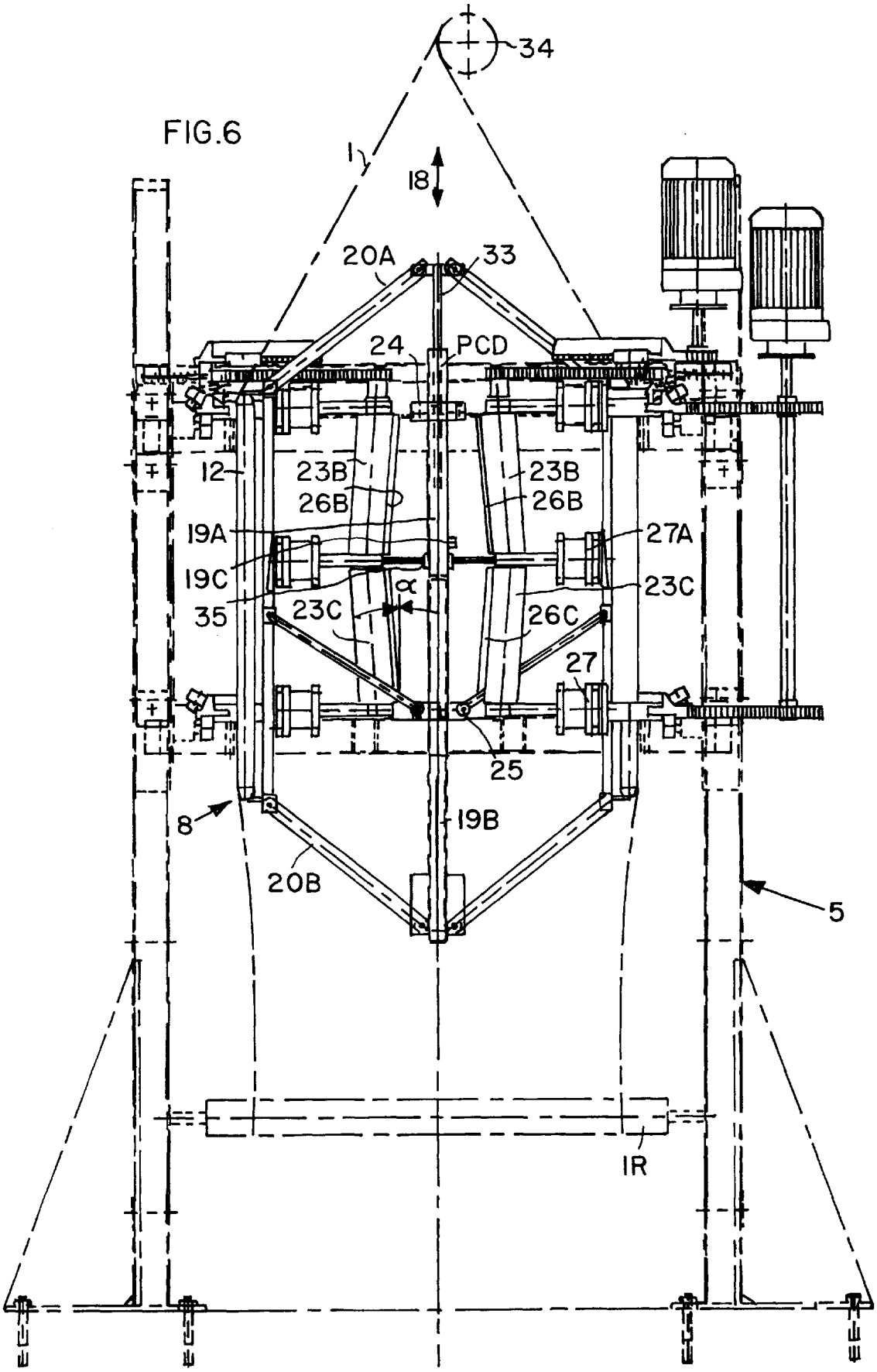
FIG. 6 is a view similar to FIG. 5 with mangling roller stations divided into upper and lower sections with rollers slanted to the vertical.

In FIG. 6 the mechanism for the spreader diameter adjustment is the same as in FIG. 5.

FIG. 6 shows the position of divided mangling stations with the spreader roller 12 and the mangling rollers 23B, 23C projected into the plane of the drawing. However, these stations and rollers are distributed around the central post 19 as in the other figures. In the embodiment according to FIGS. 4 and 5 it can happen that the spreader 8 can travel upwardly in response to the pressure of the mangling rollers assisted by a slanted position of the mangling rollers. Such upward move is not desirable. In order to avoid this problem FIG. 6 illustrates an embodiment in which the mangling stations or rather their rollers are divided into upper and lower sections with the dividing plane extending horizontally between the two sections. Thus, each mangling station comprises two roller sections 23B, 26B and 23C, 26C. These station sections are arranged vertically one above the other. The rollers of the lower sections are so arranged that a V-configuration opening upwardly is formed. The upper rollers form a V-configuration that opens downwardly. A further roller support 35 is secured centrally to the outer tubular member 19A of the carrier post 19 in the spreader 8. The roller support 35 holds the ends of the inner rollers 26B, 26C. Furthermore, an additional piston cylinder device 27A is provided for supporting and pressing each inner end of the two mangling rollers 23B, 23C. Each pair of rollers 23B, 23C has its own piston cylinder device for controlling the mangling pressure.

The just described position of the divided mangling rollers provides a compensation for any tendencies of the spreader 8 to travel upwardly in response to the fabric movement. The spreader 8 is properly held in all directions horizontally and vertically in the required position. In this connection it is not necessary to provide an additional slanting of the spreader rollers 12.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for spreading and mangling tubular knitted fabric, comprising a frame, a plurality of support rings (28, 29) rotatably mounted in said frame in horizontal planes for rotation about a longitudinal central axis (A), a rotatable fabric spreader (8) including a central carrier post (19) having a post axis coinciding with said central axis (A), said carrier post including an outer tubular member (19A), an inner member (19B) telescoping inside said outer tubular member, spreader rollers (12) and struts (20, 21) pivoted at one end to said central carrier post and pivoted at an opposite end to said spreader rollers (12) so that tilting said struts outwardly increases a diameter of said spreader (8) while tilting said struts inwardly reduces said spreader diameter, a plurality of mangling stations (13) circumferentially distributed around said spreader (8) and around said central axis (A), each mangling station comprising at least two inner mangling rollers (26) mounted to said central carrier post (19) and at least one outer mangling roller (23) and piston cylinder devices (27) mounting said outer mangling roller (23) to said support rings for cooperation with said inner mangling rollers (26), wherein said spreader is supported in the horizontal direction exclusively by said plurality of mangling stations (13), and wherein said apparatus further comprises means for adjusting said spreader diameter, said spreader diameter adjusting means cooperating with said spreader for tilting said struts (20, 21) to thereby vary said spreader diameter.

2. The apparatus of claim 1, wherein said spreader diameter adjusting means comprise a first lower roller head (11), an axial bearing (22) supported by said first lower roller head (11), said outer tubular member (19A) having a lower end resting on said axial bearing (22), a lifting and lowering mechanism (17) positioned below said first roller head (11), a second roller head (31) supported by said lifting and lowering mechanism (17), a rod (36) passing through said first roller head (11) and through said axial bearing (22) into said outer tubular member (19A) of said central carrier post (19), said rod (36) having a lower end connected to said second roller head (31) and an upper end connected to said inner member (19B) of said central carrier post (19B), so that lowering said rod (36) with said mechanism (17) tilts said struts outwardly for increasing said spreader diameter and raising said rod (36) with said mechanism (17) tilts said struts inwardly for decreasing said spreader diameter.

3. The apparatus of claim 2, wherein said inner telescoping member (19B) extends out of an upper end of said outer tubular member (19A) and wherein an up-and-down movement of said rod (36) determines a length of said inner telescoping member (19B) extending out of said outer tubular member.

4. The apparatus of claim 1, wherein said spreader diameter adjusting means comprise a single lower roller head (11), an axial bearing (22) supported by said single lower roller head, said telescoping inner member (19B) of said central carrier post (19) having a lower end extending out of said outer tubular member (19A) and resting on said axial bearing (22), a lifting and lowering mechanism (17) supporting said single lower roller head (11) so that lifting said lower roller head (11) moves said inner telescoping member (19B) upwardly into said outer tubular member (19A) thereby increasing said spreader diameter and lowering said lower roller head moves said inner telescoping member downwardly out of said outer tubular member (19A) thereby decreasing said spreader diameter.

5. The apparatus of claim 4, wherein said inner and outer mangling rollers (26, 23) are mounted at an angle ($\alpha$) inclined relative to said longitudinal central axis (A).

6. The apparatus of claim 5, wherein said spreader rollers (12) are mounted at an angle ($\beta$) inclined relative to said longitudinal central axis (A) with an inclination opposite to that of said inner and outer mangling rollers (26, 23).

7. The apparatus of claim 1, wherein said spreader diameter adjusting means comprise a piston cylinder device in said outer tubular member (19A) of said central carrier post (19), said piston cylinder device comprising a piston rod (33) extending upwardly out of said outer tubular member (19A) for an axial up-and-down movement (18), said struts comprising upper struts (20A) pivoted to an upper end of said piston rod (23), so that said spreader diameter is reduced in response to said piston rod (33) moving upwardly and so that said spreader diameter is increased in response to said piston rod (33) moving downwardly.

8. The apparats of claim 7, wherein said inner and outer mangling rollers (26, 23) are mounted at an angle ($\alpha$) inclined relative to said longitudinal central axis (A).

9. The apparatus of claim 8, wherein said spreader rollers (12) are mounted at an angle ($\beta$) inclined relative to said longitudinal central axis (A) with an inclination opposite to that of said inner and outer mangling rollers (26, 23).

10. The apparatus of claim 7, wherein each of said mangling stations (13) is divided into an upper mangling section and a lower mangling section, each section having two inner mangling rollers (26B, 26C) and an outer mangling roller (23B, 23C) cooperating with said inner mangling rollers, said apparatus further comprising roller mountings (24, 25, 35) rotatably securing said inner mangling rollers to said central carrier post (19), and wherein said piston cylinder devices (27, 27A) rotatably mounting said outer mangling roller sections to said support rings (28, 29).

11. The apparatus of claim 10, wherein said inner and outer mangling rollers of said upper mangling section are inclined at an angle ($\alpha$) to the vertical, and wherein said inner and outer mangling rollers of said lower mangling section are also inclined at an angle ($\alpha$) with an inclination opposite to that of said upper mangling section.

* * * * *